US005247985A

United States Patent [19]

Sulprizio

[11] Patent Number: 5,247,985

[45] Date of Patent: Sep. 28, 1993

[54] SPLASH METAL

[76] Inventor: Lucelio Sulprizio, 3059 Frandoras Cir., Oakley, Calif. 94561

[21] Appl. No.: 881,610

[22] Filed: May 12, 1992

[51] Int. Cl.[5] ..... B22D 25/02; B22D 13/04

[52] U.S. Cl. ..... 164/47; 283/74

[58] Field of Search ..... 164/98, 111, 4.1, 47, 164/131, 132, 150, 271; 283/74

[56] References Cited

U.S. PATENT DOCUMENTS

| | | | |
|---|---|---|---|
| 362,820 | 5/1887 | Craige | 283/74 |
| 1,302,784 | 5/1919 | Freitag | 283/74 |
| 1,364,025 | 12/1920 | Billings | 283/74 |
| 1,443,383 | 1/1923 | Reckleff et al. | 283/74 |
| 1,656,928 | 1/1928 | Wheeler | 283/74 |
| 2,098,557 | 11/1937 | Thomas | 283/74 |
| 4,283,831 | 8/1981 | Jhono | 164/45 |

*Primary Examiner*—Richard K. Seidel
*Assistant Examiner*—Erik R. Puknys
*Attorney, Agent, or Firm*—Haverstock, Medlen & Carroll

[57] ABSTRACT

A method of allowing for the identification of artistic shapes by the workpiece purchaser. Casting variable workpieces where the subject matter to be cast is not identified prior to casting.

20 Claims, 2 Drawing Sheets

FIG. 1

SPLASH METAL

FIELD OF THE INVENTION

This invention relates to artistic objects, and more particularly, to the casting and identification of artistic shapes.

BACKGROUND

Metal casting typically involves die casting. Molten metal is poured to fill the interior cavity of a die. The shape of the metal is controlled by the design of the die. In virtually all cases, the shape of the product is well defined (e.g., casting of machine parts). That is to say, if casting is complete and has been carried out as intended, the resultant workpiece will be the same every time.

Die casting is also frequently employed where an artistic shape is to be cast (busts of famous people, objects of nature, etc.). Where an artistic piece is to be mass produced, it is also essential that the casting process faithfully reproduces the object. In sum, the fact that it is purchased for artistic appeal does not change the fact that the resultant workpiece needs to be manufactured identically each time.

SUMMARY OF THE INVENTION

This invention relates to artistic shapes where each workpiece is unique and variable and where the subject matter created is not identified prior to its creation. In particular, the present invention contemplates a method of allowing for the identification of artistic shapes by the purchaser after casting and the incorporation of this identification in the final workpiece.

In one embodiment, the present invention contemplates a method of identification by a purchaser of artistic shapes, comprising: a) providing i) molten metal and ii) a means of casting molten metal; and b) casting a unique and variable workpiece from the molten metal having an identification indicator attaching means. In a preferred embodiment, the method further comprises: c) presenting the unique and variable workpiece to a purchaser for identification; d) incorporating the identification into an identification indicator; and e) attaching the indicator to the indicator attaching means.

It is not intended that the invention be limited by the type of molten metal employed. In one embodiment, the present invention contemplates that the molten metal is selected from the group comprising precious metals. In one embodiment, the molten metal selected from the group comprising aluminum, zinc, copper, brass, and iron. It is also contemplated that more than one metal and metal alloys can be used. In one embodiment, more than one metal is poured at a time. It is also contemplated that non-metals can be employed. For example, in one embodiment, glass is used along with metal. In another embodiment, paint is splashed in the same manner as the molten metal.

It is not intended that the invention be limited by the nature of the attaching means or the nature of the indicator. In one embodiment, the attaching means comprises a fitted receiving fixture cast into the workpiece. The indicator can be a metal or a non-metal. In one embodiment, the indicator is a brass plate dimensioned such that it is compatible with the fitted receiving fixture. In another embodiment, the indicator is made of magnesium.

DESCRIPTION OF THE INVENTION

This invention involves casting artistic shapes where each workpiece is unique and variable and where the subject matter to be cast is not identified prior to casting. In particular, the present invention contemplates a method of allowing for the identification of artistic shapes by the purchaser after casting and the incorporation of this identification in the final workpiece.

Since each workpiece is unique and variable and not known prior to its manufacture, the present invention contemplates having the purchaser contribute to the artistic creation by identifying and naming the product. The artistic shape may only have meaning to the purchaser, i.e., beauty is in the eye of the beholder. To allow for this meaning to be incorporated into the workpiece, it is contemplated that the product will have a means for attaching an indicator that will reveal the purchaser's identification of the workpiece (e.g., a fanciful name, the purchaser's name, etc.). In one embodiment, the indicator is a brass plate dimensioned such that it is compatible with the fitted receiving fixture that is cast into the workpiece.

The fixture can be cast into the workpiece in a number of ways. For example, the molten metal can be poured or "splashed" onto a surface having internal boundaries in the manner of a stencil. While the overall shape of the hardened workpiece will not be the same, the stencil will provide an internal fixture for receiving the indicator.

It is not intended that the position of the indicator within the workpiece be limited to any one area. Furthermore, it is not intended that the internal boundaries be employed solely for the purpose of creating the fixture. Indeed, a unique stencil can be employed for each casting to provide artistic forms within the casting.

Where the indicator is a plate (e.g., brass, magnesium, etc.), the identification by the purchaser can be revealed, for example, by etching the brass plate with a name. The purchaser can provide the name at the time of purchase. On the other hand, the purchaser may take the workpiece for viewing and reflection. When the purchaser, in this case, decides on the artistic meaning to be assigned the workpiece, the purchaser communicates this and the brass plate is subsequently etched. In this manner, the indicator may be attached by the purchaser at a time well after the casting and the identification by the purchaser need not be limited in any way.

Figure 1:
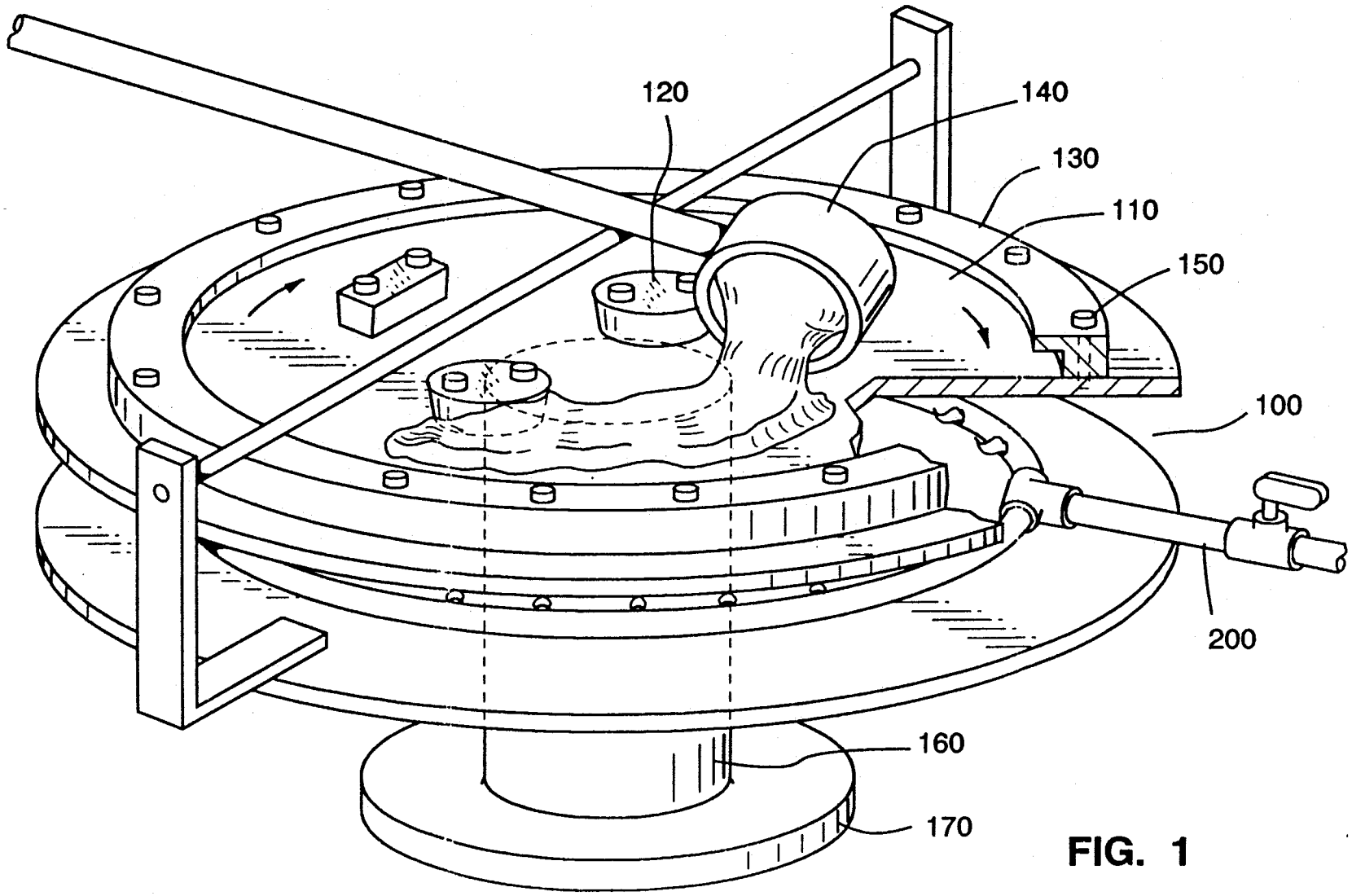
FIG. 1 is a perspective view of a casting table for casting unique and variable workpieces from molten metal.

In FIG. 1, internal boundaries are provided by protrusions in a casting table. These protrusions can be mounted by bolting or the like. By showing simple shapes (squares and circles) in FIG. 1, it is not meant to indicate a limitation on the possible shapes of the protrusions.

FIG. 1 shows a manually operated means of providing molten metal. Such a means can be quickly adapted to an automated providing means. However, a manually operated means allows for a great deal of artistic freedom for each workpiece.

Figure 3:
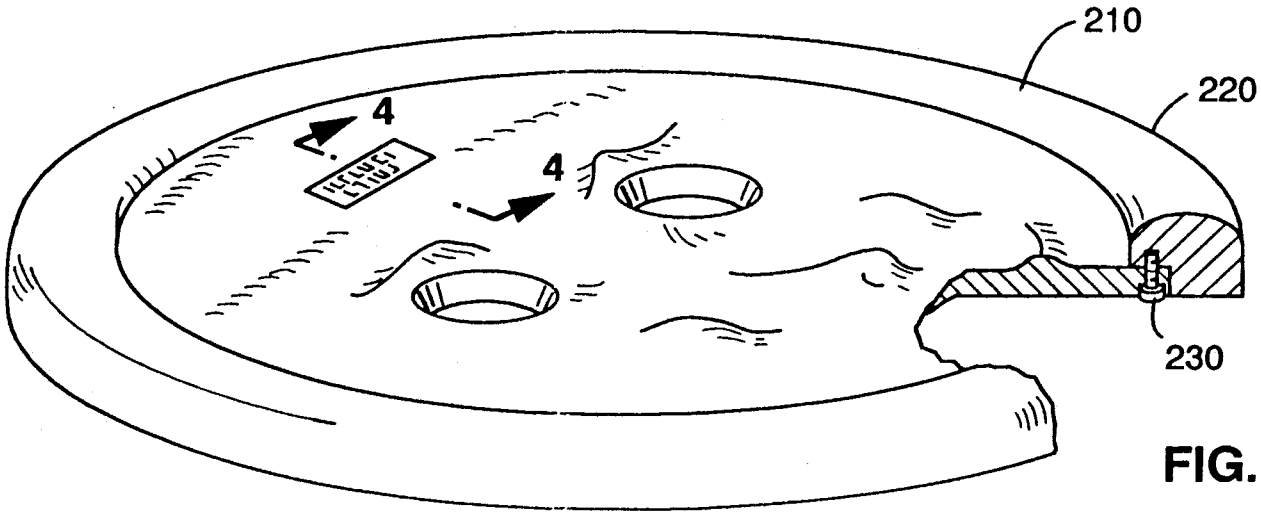
FIG. 3 is a side elevational view partially in section of a workpiece produced according to the method of the present invention.

The outer edges of the casting table are firmly attached to the surface. Again, this outer boundary is merely illustrative and can take other forms and dimensions. This outer edge can be conveniently designed to allow for removal of the workpiece and framing of the workpiece (e.g., in a wooden frame). FIG. 3 shows a finished workpiece removed from the casting table and framed.

It is contemplated that the surface of the casting table can rotate and that the speed of rotation can be controlled and varied. The body of the table, however, conveniently remains stationary while the surface moves.

The table can be heated by a flame (see FIG. 2) as gas is admitted under the surface to various gas ports. Gas may be admitted in the normal manner with lines directly connecting to a gas source. However, the gas may also be admitted up through the middle of the table if desired.

It is contemplated that the level of molten metal employed in casting may vary greatly as to thickness. It is not intended that the metal fully contact the internal or external boundaries.

In the practice of the present invention, there are inherent dangers. Wearing the proper protective apparel and equipment when working near molten aluminum is extremely important in preventing injury. See *Guidelines for Handling Molten Aluminum*, published by the Aluminum Association Inc. See also the mandatory standards or guidelines issued by regulatory agencies (Federal or State OSHA, MSHA, etc.) or advisory standards groups (ANSI, ASTM, NFPA, ACGIH, etc.). Furthermore, it is contemplated that the casting table shown in FIGS. 1 and 2 could be fitted with a suitable shield (not shown) so that workers are protected from contact with the molten metal.

Safety head gear meeting the specifications of American National Standard (ANS) Z89.1, Requirements for Protective Headwear for Industrial Workers, should also be worn. Furthermore, when pouring metal, industrial-type, heat resistant and/or flame retardant gloves should be worn.

DESCRIPTION OF THE PREFERRED EMBODIMENTS

Figure 2:
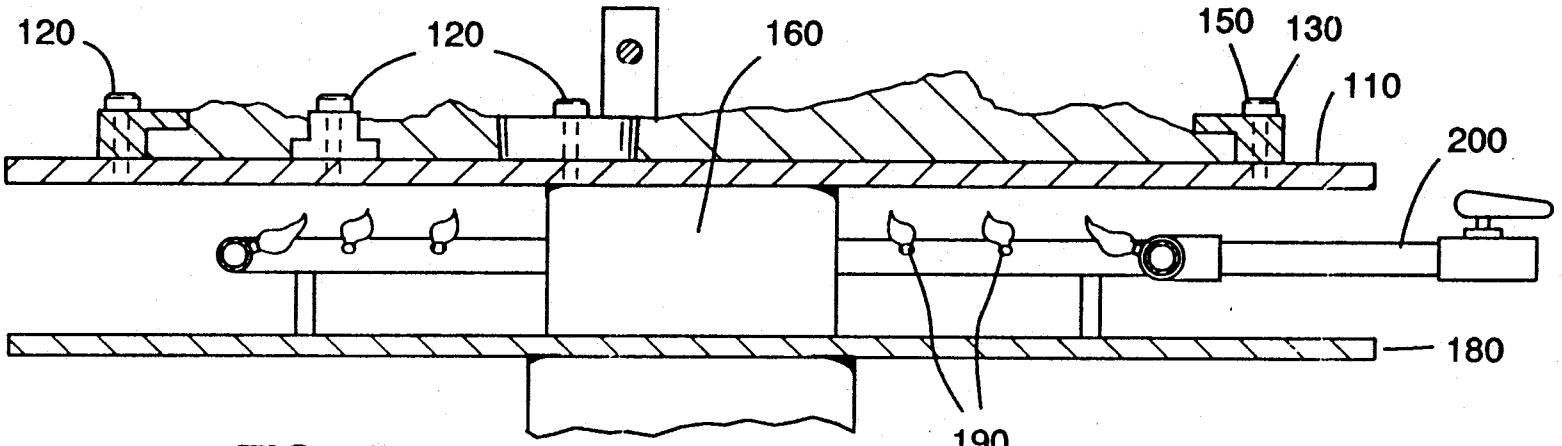
FIG. 2 is a sectional view of FIG. 1 showing the means of heating the surface of the table having molten metal.

As shown in FIGS. 1 and 2, the preferred casting means for the present invention comprises a casting table (100). In one embodiment, the casting table (100) comprises a heated, circular, rotatable surface (110) having integrally mounted internal boundaries (120) including a boundary to generate a receiving fixture. The outer edges (130) allow for control over the casting material, such as molten metal.

FIG. 1 shows a manually operated means of providing molten metal, namely a ladle (140). For pouring more tan one metal, more than one ladle can be used.

The outer edges (130) of the casting table are firmly attached to the surface via bolts (150). The surface (110) of the casting table (100) rotates on a column (160) supported by a base (170). The speed of rotation can be manually controlled and varied. Alternatively, a motor can be employed (not shown). The lower surface (180) of the casting table (100) conveniently remains stationary while the surface moves.

The table (100) can be heated by a flame. In one embodiment, gas is admitted under the surface to various gas ports (190) via gas lines (200) directly connecting to a gas source (not shown).

FIG. 3 shows a finished workpiece (210) removed from the casting table (100) and framed with a wooden frame (220). The frame (220) can be mounted in any manner, such as by the use of mounting bolts (230).

Figure 4:
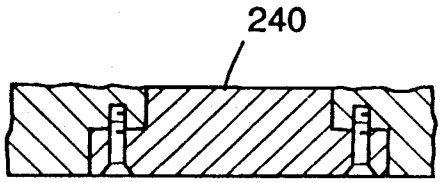
FIG. 4 shows one embodiment of a fitted receiving fixture wherein the indicator is back-mounted.
Figure 5:
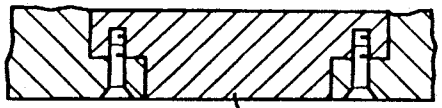
FIG. 5 shows one embodiment of a fitted receiving fixture wherein the indicator is front-mounted.

FIG. 4 shows one embodiment of a fitted receiving fixture (240) wherein the indicator is back-mounted. FIG. 5 shows one embodiment of a fitted receiving fixture (240) wherein the indicator is front-mounted.

Although a preferred embodiment has been described with some particularity, many modifications and variations of the preferred embodiment are possible without deviating from the invention.

I claim:

1. A method of creating a workpiece comprising hardened molten metal having a unique and variable shape, comprising:

a) providing i) molten metal and ii) a means of casting molten metal comprising a casting surface with integrally mounted internal boundaries; and b) pouring said molten metal on to said casting surface so as to contact said internal boundaries and create a workpiece having an integral identification indicator attaching means.

2. The method of claim 1 further comprising:

c) providing an identification indicator; and d) attaching said indicator to said indicator attaching means.

3. The method of claim 1 wherein the molten metal is selected from the group comprising aluminum, zinc, copper, brass, and iron.

4. The method of claim 2 wherein said attaching means comprises a fitted receiving fixture cast into said workpiece.

5. The method of claim 4 wherein said indicator comprises a plate dimensioned such that it is compatible with said fitted receiving fixture.

6. The method of claim 5 wherein said plate is made of brass.

7. The method of claim 5 wherein said plate is made of magnesium.

8. A method of creating a workpiece comprising hardened molten metal having a unique and variable shape, comprising:

a) providing i) a plurality of molten metals and ii) a means of casting molten metal comprising a casting surface with integrally mounted internal boundaries; and b) pouring each of said molten metals separately on to said casting surface so as to contact said internal boundaries and create a workpiece from a mixture of said molten metals having an integral identification indicator attaching means.

9. The method of claim 8 further comprising:

c) providing an identification indicator; and d) attaching said indicator to said indicator attaching means.

10. The method of claim 8 wherein said mixture of molten metals is comprised of two metals selected from the group comprising aluminum, zinc, copper, brass, and iron.

11. The method of claim 9 wherein said attaching means comprises a fitted receiving fixture cast into said workpiece.

12. The method of claim 9 wherein said indicator comprises a plate dimensioned such that it is compatible with said fitted receiving fixture.

13. The method of claim 12 wherein said plate is made of brass.

14. The method of claim 12 wherein said plate is made of magnesium.

15. A method of creating a workpiece comprising hardened molten metal and a non-metal having a unique and variable shape, comprising:

a) providing i) molten metal, ii) a non-metal, and iii) a means of casting molten metal comprising a casting surface with integrally mounted internal boundaries; and b) adding said non-metal and pouring said molten metal on to said casting surface so as to contact said internal boundaries and create a workpiece from said molten metal and said non-metal having an integral identification indicator attaching means.

16. The method of claim 15 further comprising:

c) providing an identification indicator; and d) attaching said indicator to said indicator attaching means.

17. The method of claim 16 wherein said non-metal is glass.

18. A method of creating a workpiece comprising hardened molten metal having a unique and variable shape, comprising:

a) providing i) molten metal, and ii) a casting table having a surface with mounted protrusions to provide internal boundaries; and b) pouring said molten metal on to said table surface so as to contact said protrusions and create a workpiece from said molten metal having an integral identification indicator attaching means.

19. The method of claim 18 further comprising:

c) providing an identification indicator; and d) attaching said indicator to said indicator attaching means.

20. The method of claim 18, wherein said surface of said table is rotated while pouring said molten metal.

* * * * *